US006461026B1

(12) United States Patent
Wang

(10) Patent No.: US 6,461,026 B1
(45) Date of Patent: Oct. 8, 2002

(54) LUMINAIRE CENTERING HINGE

(75) Inventor: James P. Wang, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/850,193

(22) Filed: May 8, 2001

(51) Int. Cl.[7] ..... F21V 21/00
(52) U.S. Cl. ..... 362/374; 362/375; 16/267
(58) Field of Search ..... 362/365, 366, 362/368, 371, 374, 375; 16/239, 259, 266, 267, 381

(56) References Cited

U.S. PATENT DOCUMENTS

| | | | | |
|---|---|---|---|---|
| 106,315 A | | 8/1870 | Browne | |
| 771,654 A | * | 10/1904 | Meek | 16/267 |
| 1,075,569 A | | 10/1913 | Holtzhouser | |
| 1,132,601 A | | 3/1915 | Moynihan | |
| 2,732,581 A | | 1/1956 | Heck | 16/171 |
| 3,295,714 A | | 1/1967 | Addario | 220/31 |
| 3,380,770 A | | 4/1968 | Risley | 292/175 |
| 4,349,120 A | | 9/1982 | DiNardo | 220/337 |
| 5,005,458 A | | 4/1991 | Merrick | 83/599 |
| 5,172,976 A | | 12/1992 | Bogdanovs | 362/374 |
| 5,311,643 A | * | 5/1994 | Marquardt et al. | 16/267 |
| 5,864,922 A | | 2/1999 | Kraft | 16/266 |
| 6,041,846 A | * | 3/2000 | Langlois | 16/267 |

* cited by examiner

*Primary Examiner*—Sandra O'Shea
*Assistant Examiner*—John Amarantides
(74) *Attorney, Agent, or Firm*—Mark S. Bicks; Tara L. Hoffman

(57) ABSTRACT

A lighting fixture includes a housing, a frame, and a hinge assembly pivotally coupling the frame to the housing. The hinge assembly includes a first hinge part fixed to and extending from the housing and has first and second support arms and a pin extending between the support arms. A centering bar is located between the first and second support arms. The hinge assembly also includes a second hinge part extending from the frame and slidably engaged with the first hinge part. The second hinge part has a first arcuate lead arm and a first trap arm defining a receiving area between the lead arm and the trap arm. The pin of the first hinge part is received in the receiving area of the second hinge part. This allows the second hinge part to slide relative to the pin. Each of the lead and trap arms of the second hinge part is disposed near opposite sides of the centering bar of the first hinge part.

20 Claims, 2 Drawing Sheets

FIG. 1
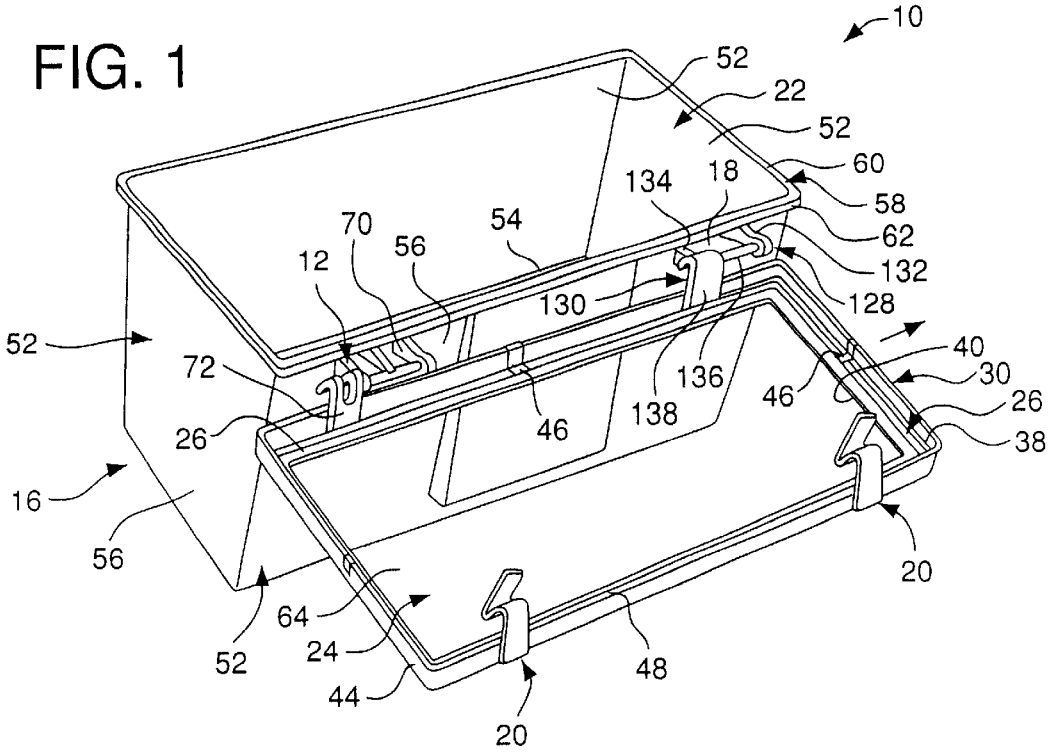
FIG. 2
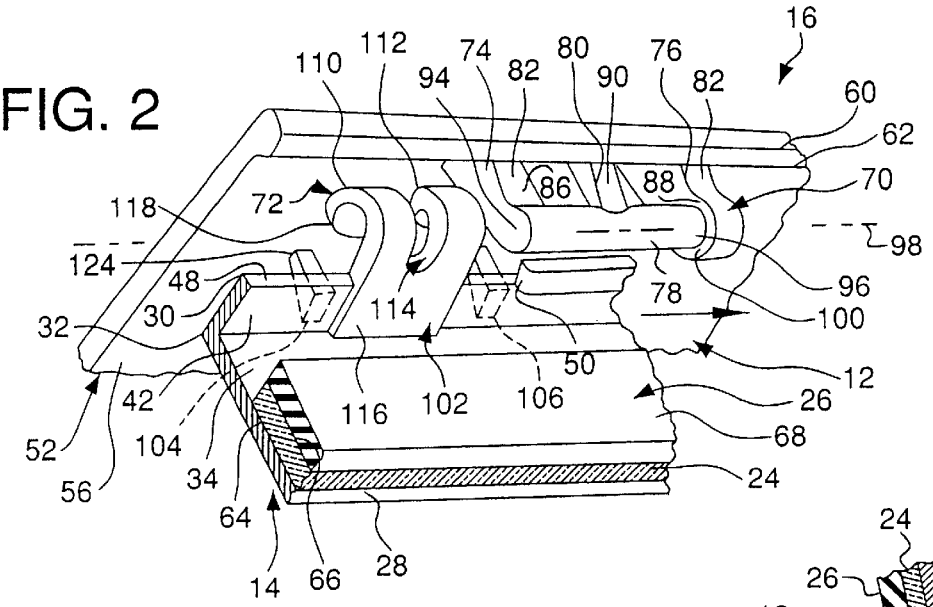
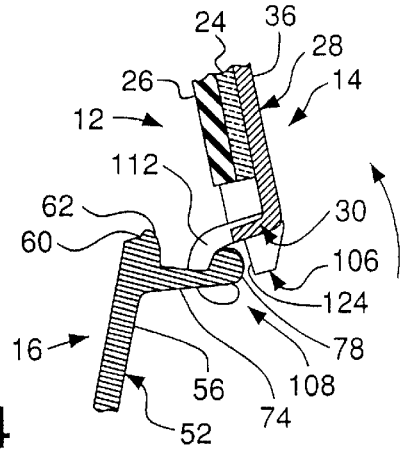
FIG. 4

LUMINAIRE CENTERING HINGE

FIELD OF THE INVENTION

The present invention generally relates to a centering hinge for a lighting fixture or luminaire. Specifically, the invention relates to a two part hinge for coupling a door frame and housing of a lighting fixture including a mechanism for centering the door frame onto the housing.

BACKGROUND OF THE INVENTION

Conventional lighting fixtures or luminaires generally include a housing with a lamp assembly supported therein and a lens attached to and enclosing the housing. Additionally, the lens of a conventional fixture typically includes a frame. The lens and frame define a door for the fixture housing.

Standard hinges for conventional light fixtures typically do not provide a positioning mechanism. Therefore, upon closing the frame onto the lighting fixture housing, the frame is askew or off center from the housing. This reduces the aesthetic appeal of the fixture. Additionally, a gap can be created between the frame and housing thereby preventing a weather tight seal for the fixture. Thus, the operator would be required to readjust the position of the frame to create a seal.

Examples of conventional lighting fixture hinges are disclosed in U.S. Pat. No. 106,315 to Browne; U.S. Pat. No. 1,075,569 to Holtzhouser; U.S. Pat. No. 1,132,601 to Moynihan; U.S. Pat. No. 2,732,581 to Heck; U.S. Pat. No. 3,295,714 to Addario; U.S. Pat. Nos. 4,349,120; 5,005,458 to Merrick; U.S. Pat. No. 5,172,976 to Bogdanovs; U.S. Pat. No. 5,864,922 to Kraft.

SUMMARY OF THE INVENTION

Accordingly, an object of the present invention is to provide a hinge for a luminaire or lighting fixture that centers the frame onto the housing of the fixture.

Another object of the present invention is to provide a hinge for a luminaire or lighting fixture that assists in creating a seal between the fixture frame and housing.

Yet another object of the present invention is to provide a hinge for a luminaire or lighting fixture that immediately and automatically centers the frame with respect to the fixture housing.

The foregoing objects are basically attained by a lighting fixture comprising a housing, a frame, and a hinge assembly pivotally coupling the frame to the housing. The hinge assembly includes a first hinge part fixed to and extending from the housing and has first and second support arms and a pin extending between the support arms. A centering bar is located between the first and second support arms. The pin has a longitudinal axis. The hinge assembly also includes a second hinge part extending from the frame and slidably engaged with the first hinge part. The second hinge part has a first arcuate lead arm and a first trap arm defining a receiving area between the lead arm and the trap arm. The pin of the first hinge part is received in the receiving area of the second hinge part. This allows the second hinge part to slide relative to the pin along its longitudinal axis. Each of the lead and trap arms, respectively, of the second hinge part is disposed near opposite sides of the centering bar of the first hinge part.

The foregoing objects are also basically attained by a method of centering and pivotally connecting a frame on a housing having a first hinge part on the frame. The first hinge part includes first and second support arms with a pin extending therebetween along a longitudinal axis, and a centering bar located between the first and second support arms. A second hinge part on the housing includes a first lead arm and a first trap arm defining a receiving area therebetween. The method comprises the step of engaging the second hinge part with the first hinge part by sliding the second hinge part onto the first hinge part with the first support arm of the first hinge part moving between the first lead and trap arms of the second hinge part allowing the lead and trap arms of the second hinge part to slide onto the pin of the first hinge part along the longitudinal axis of the pin. The first lead arm of the second hinge part is slid past the centering bar of the first hinge part, and the second hinge part is rotated about the longitudinal axis of the pin of the first hinge part with the centering bar of the first hinge part being located between the first lead and trap arms of the second hinge part.

By fashioning and using the hinge assembly in this manner, the frame is immediately and automatically centered with respect to the fixture housing upon closing the frame onto the housing.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure:

FIG. 1 is a perspective view of the luminaire and centering hinge in accordance with an embodiment of the present invention, showing a frame and a housing of the luminaire in an open position and just prior to being engaged;

FIG. 2 is an enlarged partial front perspective view of the centering hinge, frame, and housing of the centering hinge illustrated in FIG. 1, showing first and second hinge parts just prior to be engaged;

FIG. 4 is a partial side elevational view in section of the centering hinge, frame, and housing illustrated in FIG. 3, showing the frame pivoting to a closed position;

DETAILED DESCRIPTION OF THE INVENTION

Figure 3:
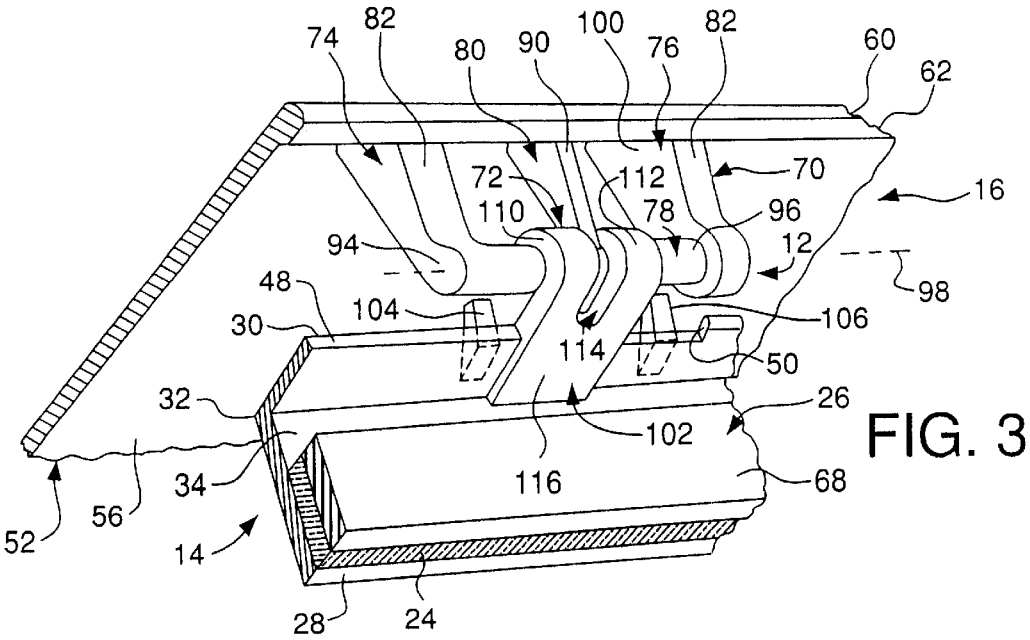
FIG. 3 is an enlarged partial front perspective view of the centering hinge, frame, and housing illustrated in FIG. 2, showing the first and second hinge parts engaged.

Referring to FIGS. 1–6, a luminaire or lighting fixture centering or positioning hinge assembly 12 in accordance with the present invention pivotally couples a frame 14 and a housing 16 of a luminaire 10. Centering or positioning hinge assembly 12 centers frame 14 with respect to housing 16 immediately and automatically upon coupling frame 14 and housing 16 via hinge assembly 12.

Luminaire 10 generally includes frame 14, such as a door, pivotally coupled to housing 16 by centering or positioning hinge assembly 12 and a second hinge assembly 18. Luminaire 10 is opened and closed by pivoting frame 14. Latches 20 provide a mechanism for latching and unlatching frame 14 and housing 16. The latches 12 are described in my concurrently filed, co-pending and commonly assigned application Ser. No. 09/850,409 entitled Luminaire Latch, the subject matter of which is herein incorporated by reference. Luminaire housing 16 includes an inner receiving area 22 for holding lighting components (not shown), such as lamp and socket assemblies, a reflecting member, or a ballast unit, as is well known in the art and shown in U.S. Pat. No. 6,182,848 entitled Luminaire Housing With Universal Dual Surface Cantilever Hinge, the subject matter of which is herein incorporated by reference.

Supported by frame 14 is refractor or lens 24, such as a glass panel, with a gasket 26 applied to the perimeter of lens 24 on a surface opposite frame 14. Gasket 26 provides a seal when luminaire 10 is closed, thereby protecting the inner components enclosed within inner receiving area 22 of luminaire housing 16 from environmental contaminants. Gasket 26 is preferably made of a plastic or rubber or similar material.

Frame 14 particularly includes a frame wall 28 and a shoulder wall 30 joined at frame edge 32 forming a generally L-shaped frame in section, as seen in FIGS. 1 and 2. Frame wall 28 includes inner and outer generally planar surfaces 34 and 36, respectively, and an inner edge 38 defining the border of a center opening 40. Shoulder wall 30 includes inner and outer generally flat surfaces 42 and 44, respectively, with inner surface 42 providing support for lens 24. Clips 46 attached to shoulder 30 secure lens 24 to inner frame wall surface 34. Shoulder wall 30 also includes a free edge 48 opposite frame edge 32 where frame wall 28 and shoulder wall 30 meet. Free edge 48 has a cutout portion 50.

Housing 16 is formed of four side walls 52 and an end wall 54, defining inner receiving area 22 and an outer housing surface 56 with an access opening or open end 58 opposite end wall 50. A shoulder 60 extends along the free edges of side walls 52 at open end 58. The surface 62 of shoulder 60 remote from side walls 52 is substantially rounded.

Figure 5:
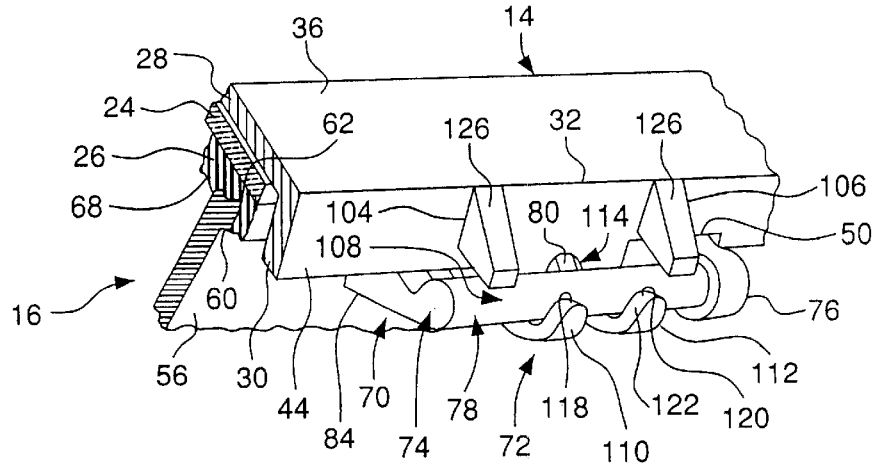
FIG. 5 is an enlarged partial top perspective view of the centering hinge, frame, and housing illustrated in FIG. 3, showing the frame closed onto the housing.

Lens 24 is supported by frame 14 with its first substantially planar surface 64 abutting inner frame wall surface 34. A second planar surface 66, opposite first surface 64, abuts gasket 26. The surface 68 of gasket 26 remote from lens 24 abuts housing shoulder surface 62 when luminaire 10 is closed, as seen in FIG. 5. Lens 24 extends across central opening 40 allowing light of the lamp assembly enclosed within luminaire housing 16 to shine therethrough.

As best seen in FIGS. 2–6, positioning hinge assembly 12 includes cooperating first and second parts 70 and 72. First part 70 extends outwardly from housing 16 and a second part 72 extends from frame 14. Second part 72 rotates about first part 70 thereby moving frame 14 between open and closed positions with respect to housing 16. The first and second parts could be reversed.

First part 70 generally has first and second support arms 74 and 76 with a pin 78 extending therebetween, and a centering bar 80 located between said first and second support arms 74 and 76, as best seen in FIG. 2. First part 70 particularly extends from a housing side wall 52 just below shoulder 60. Preferably, first part 70 is unitary with housing side wall 52 but can be formed separately and integrally attached thereto.

Figure 6:
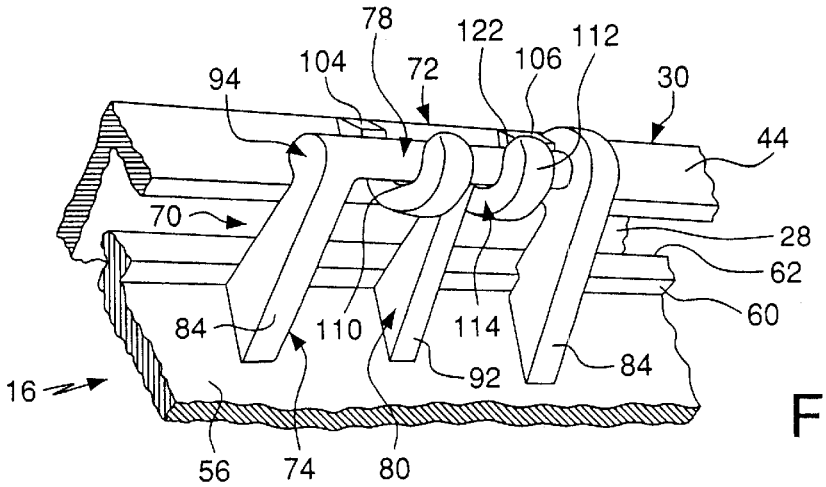
FIG. 6 is an enlarged partial bottom perspective view of the centering hinge, frame, and housing illustrated in FIG. 5.

Support arms 74 and 76, and centering bar 80 are generally perpendicular to housing outer surface 56. Pin 78 extends between and generally perpendicular to supports arms 74 and 76, and centering bar 80, at a location remote from housing outer surface 56. Each support arm 74 and 76 is generally elongated with upper and lower planar surfaces 82 and 84 as seen in FIGS. 2 and 6. The free ends 86 and 88 of first and second support arms 74 and 76, respectively, are generally rounded.

Centering bar 80 also includes upper and lower generally planar surfaces 90 and 92. However, centering bar upper surface 90 can be rounded to facilitate engagement with second hinge part 72. Pin 78 is a cylindrical member having a first end 94 forming the free end 86 of first arm 74 and a second end 96 meeting the free end 88 of second support arm 76 and defining a longitudinal axis 98. First support arm 74 and centering bar 80 are narrower than second support arm 76 in the vertical direction of FIG. 1. This allows second hinge part 72 to slide onto pin 78 at its first end 94 and also prevents it from sliding off of the second pin end 96 by second support arm inner stopping surface 100.

Second part 72 extends from frame shoulder wall 30. Second part 72 includes a trough member 102 and first and second trap arms 104 and 106, defining a receiving area 108 therebetween for receiving first hinge part 70, as best seen in FIGS. 4 and 5, forming a substantially C-shaped member.

Trough member 102 particularly includes first and second arcuate lead arms 110 and 112 defining a slot 114 therebetween for receiving centering bar 80 of first hinge part 70. Slot 114 is slightly wider than centering bar 80. Lead arms 110 and 112 extend outwardly in a direction away from free edge 48 of shoulder wall 30 and generally perpendicular to frame wall 28. Lead arms 110 and 112 also extend from a main portion 116 of trough member 102, that is preferably unitary with shoulder wall 30. Lead arms 110 and 112 have distal ends 118 and 120, respectively, forming hooking members for engaging pin 78 of first hinge part 70. Either of first and second lead arms 110 and 112 can include a slightly sloped surface 122 at their respective ends 118 and 120, as seen in FIG. 5, to facilitate engagement with centering bar 80.

First and second trap arms 104 and 106 are spaced from lead arms 110 and 112 and extend outwardly from shoulder wall outer surface 30, generally parallel with frame wall 28 and proximate to frame edge 32. Each trap arm 104 and 106 includes a generally flat surface 124 that faces lead arms 110 and 112 and an opposite sloped surface 126 so that each trap arm 104 and 106 is generally triangular in cross-section. Although trap arms 104 and 106 are preferably triangular in section, they can be any shape, as long as surface 124 is only slightly spaced from pin 78 when first and second hinge parts 70 and 72 are engaged, as seen in FIGS. 4 and 6.

Designation of upper or lower for elements of luminaire 10 and hinge 12 are used merely to facilitate description thereof and is therefore not limited to a hinge or luminaire of any particular orientation.

As seen in FIG. 1, second hinge assembly 18 is spaced from positioning hinge assembly 12. Second hinge assembly 18 is a conventional hinge having first and second parts 128 and 130. First part 128 extends from housing side wall 52 and includes first and second arms 132 and 134 with a pin 136 extending therebetween. Second part 130 extends from frame shoulder wall 30, similar to second part 72 of positioning hinge 12. Second part 130 of second hinge 18 includes a hooking member 138 that engages and pivots about pin 136. Like positioning hinge 12, first arm 132 of first part 128 is narrower than second arm 134, thereby allowing second part 130 to slide onto pin 136.

Second hinge 18 can include first and second trap arms similar to positioning hinge 12. Also, second hinge pin 18 can be a second substantially identical positioning hinge to hinge 12 instead of a conventional hinge.

Operation

As seen in FIGS. 1–6, frame 14 and housing 16 are coupled by axially sliding each second hinge part 72 and 130 of positioning and second hinges 12 and 18, respectively, onto their corresponding first hinge parts 70 and 128, respectively. In this position, frame 14 is inverted and in an open position with its shoulder wall outer surface 44 facing housing 16, such that the receiving area 108 between the lead and trap arm is aligned with and can receive support arm 74 and centering bar 80. Each second hinge part 72 and 130 is slid in a direction toward their respective second support arms 76 and 134, indicated by an arrow in FIGS. 1 and 2, until each part engages their respective pins 78 and 136.

Specifically turning to positioning hinge assembly 12, as seen in FIGS. 2–4, second hinge part 72 slides over first support arm 74 along axis 98 so that trough member 102 engages pin 78 at its first end 94 and until second lead arm 112 clears centering bar 80. Pin 78 will then be disposed in receiving area 108 between trough member 102 and trap arms 104 and 106. As such, first hinge part 70 is substantially prevented from being disengaged from second hinge part 74 since pin 78 is trapped between trough member 102 and trap arms 104 and 106.

Hinge 12 centers frame 14 with respect to housing 16 immediately upon engagement of centering bar 80 of first hinge part 70 and trough member 102 of second hinge part 72 as seen in FIG. 3. In particular, centering bar 80 is received in slot 114 between lead arms 110 and 112 of trough member 102 upon pivoting of the frame towards its closed position, thereby generally preventing axial movement of second hinge part 72 and frame 14 with respect to first hinge part 70 and housing 16. Second trap arm 106 also assists in preventing axial movement by abutting against second supporting arm 76. Cutout portion 50 of frame shoulder wall 30, provides clearance for second support arm 76 when sliding first hinge part 70 onto second hinge part 72. Also, upon initial engagement of trough member 102 and centering bar 80, sloped surface 122 of second lead arm 112 will abut upper surface 90 of centering bar 80. A rounded upper surface 90 of centering bar 80 and slope surface 122 of lead arm 112 provides a smoother, camming engagement of the two members. However, sloped surface 122 and rounded surface 90 are not necessary for the engagement of trough member 102 and centering bar 80.

Once first and second hinge parts 70 and 72 are engaged, second hinge part 72 and frame 14 can be rotated to a closed position about pin 78 of first hinge part 70. Likewise, with respect to second hinge assembly 18, hooking member 138 can rotate about pin 136.

As seen in FIGS. 4–6, positioning hinge 12 second part 72 pivots about pin 78 of first hinge part 70 thereby pivoting frame 14 onto the free edges of housing side walls 52. Surface 68 of gasket 26 abuts housing shoulder rounded surface 60, as seen in FIG. 5, thereby creating a weather tight seal. Centering bar 80 maintains engagement with slot 114 of trough member 102 while frame 14 pivots so that once frame 14 is closed onto housing 16, it is centered thereon.

While a particular embodiment has been chosen to illustrate the invention, it will be understood by those skilled in the art that various changes and modifications can be made therein without departing from the scope of the invention as defined in the appended claims.

What is claimed is:

1. A lighting fixture, comprising:

a housing;

a frame; and a hinge assembly pivotally coupling said frame to said housing including, a first hinge part fixed to and extending from said housing and having first and second support arms, a pin extending between said support arms, and a centering bar located between said first and second support arms, said pin having a longitudinal axis, and a second hinge part extending from said frame and slidably engaged with said first hinge part, said second hinge part having a first arcuate lead arm and a first trap arm defining a receiving area between said lead arm and said trap arm, said pin of said first hinge part being received in said receiving area of said second hinge part allowing said second hinge part to slide relative to said pin along said longitudinal axis, each of said lead and trap arms, respectively, of said second hinge part being disposed near opposite sides of said centering bar of said first hinge part.

2. A lighting fixture according to claim 1, wherein said second hinge part includes a second arcuate lead arm disposed proximate said first lead arm with a slot defined therebetween that receives said centering bar of said first hinge part.

3. A lighting fixture according to claim 2, wherein said second hinge part includes a second trap arm separated from said first trap arm by a space; and said space between said first and second trap arms being substantially larger that said slot between said first and second lead arms.

4. A light fixture according to claim 1, wherein said second hinge part rotates about said longitudinal axis of said pin of said first hinge part between an open position with said frame spaced from said housing and a closed position with said frame engaged with said housing.

5. A light fixture according to claim 1, wherein said first support arm of said first hinge part fits between said lead and trap arms of said second hinge part, thereby allowing said second hinge part to slide onto said pin of said first hinge part at said first support arm.

6. A light fixture according to claim 1, wherein said second support arm of said first hinge part engages said lead and trap arms of said second hinge part preventing sliding thereof along said pin of said first hinge part past said second support arm.

7. A light fixture according to claim 1, wherein each of said lead and trap arms of said second hinge part have an inner surface;

said lead arm is located above said trap arm with said inner surface of said lead arm facing said inner surface of said trap arm so that said second hinge part has a substantially C-shape.

8. A light fixture according to claim 1, wherein each of said first and second support arms and said centering bar of said first hinge part are substantially parallel; and said pin of said first hinge part is substantially perpendicular to said first and second support arms and said centering bar.

9. A light fixture according to claim 1, wherein each of said first and second hinge parts are unitary one-piece members.

10. A lighting fixture, comprising:

a housing;

a frame; and a hinge assembly pivotally coupling said frame to said housing including, a first hinge part extending from said housing and having first and second support arms with a pin extending therebetween, said pin having a longitudinal axis, and a centering bar located between said first and second support arms, and a second hinge part extending from said frame and slidably engaged with said first hinge part, said second hinge part having first and second arcuate lead arms defining a slot therebetween, and a first trap arm defining a receiving area between said first and second leads arms and said first trap arm, said pin of said first hinge part being received in said receiving area of said second hinge part allowing said second hinge part to slide relative to said pin along said longitudinal axis, said centering bar of said first hinge part being received in said slot of said second hinge part.

11. A lighting fixture according to claim 10, wherein said second hinge part rotates with respect to said longitudinal axis of said pin of said first hinge part between an open position with said frame spaced from said housing and a closed position with said frame engaged with said housing.

12. A lighting fixture according to claim 10, wherein said second hinge part includes a second trap arm spaced from said first trap arm.

13. A lighting fixture according to claim 10, wherein said first and second lead arms of said second hinge part are aligned with one another; and each of said first and second lead arms extend towards said first trap arm.

14. A lighting fixture according to claim 13, wherein said first and second lead arms and said first trap arm of said second hinge part form a substantially C-shaped member.

15. A lighting fixture according to claim 10, wherein each of said first and second support arms and said centering bar of said first hinge part are substantially parallel; and said pin of said first hinge part is substantially perpendicular to said first and second support arms and said centering bar.

16. A lighting fixture according to claim 10, wherein each of said first and second hinge parts are unitary one-piece members.

17. A lighting fixture according to claim 10, wherein each of said first and second hinge parts are metal.

18. A method of centering and pivotally connecting a frame on a housing having a first hinge part on the frame, including first and second support arms with a pin extending therebetween along a longitudinal axis, and a centering bar located between the first and second support arms, and having a second hinge part on the housing, including a first arcuate lead arm and a first trap arm defining a receiving area therebetween, comprising the steps of:

engaging the second hinge part with the first hinge part by sliding the second hinge part onto the first hinge part with the first support arm of the first hinge part moving between the first lead and trap arms of the second hinge part allowing the lead and trap arms of the second hinge part to slide onto the pin of the first hinge part along the longitudinal axis of the pin;

sliding the first lead arm of the second hinge part past the centering bar of the first hinge part; and rotating the second hinge part about the longitudinal axis of the pin of the first hinge part with the centering bar of the first hinge part being located between the first lead and. trap arms of the second hinge part.

19. A method of centering a frame on a housing according to claim 18, further comprising the step of the frame is rotated between an open position with the frame spaced from the housing and a closed position with the frame engaged with the housing.

20. A method of centering a frame on a housing according to claim 18, wherein the second hinge part includes a second arcuate lead arm forming a slot between the first and second lead arms;

the second hinge part includes a second trap arm separated from the first trap arm by a space;

the centering bar of the first hinge part is received in the slot of the second hinge part; and the space between the first and second trap arms is substantially larger that the slot between the first and second lead arms.

* * * * *